US006755202B1

(12) United States Patent
Scholey et al.

(10) Patent No.: US 6,755,202 B1
(45) Date of Patent: Jun. 29, 2004

(54) RINSING DEVICE

(75) Inventors: Ian Kenneth Scholey, Wakefield (GB); Ralph Frederick Hussey, Leeds (GB); Andrew Goldsbrough, Haworth (GB)

(73) Assignee: Crown Cook & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/869,072

(22) PCT Filed: Dec. 20, 1999

(86) PCT No.: PCT/GB99/04315

§ 371 (c)(1),
(2), (4) Date: Jan. 17, 2002

(87) PCT Pub. No.: WO00/38851

PCT Pub. Date: Jul. 6, 2000

(30) Foreign Application Priority Data

Dec. 23, 1998 (GB) ..... 9828333

(51) Int. Cl.[7] ..... B08B 3/02

(52) U.S. Cl. ..... 134/69; 134/80; 134/82; 134/83; 134/158; 134/169 R

(58) Field of Search ..... 134/66, 69, 78, 134/80, 82, 83, 158, 166 R, 169 R, 62

(56) References Cited

U.S. PATENT DOCUMENTS 1,677,443 A * 7/1928 Hansen
1,717,998 A * 6/1929 Olmsted
1,814,551 A * 7/1931 Graban
1,997,792 A * 4/1935 Holmquist
2,184,100 A * 12/1939 Mondloch
2,333,094 A * 11/1943 De Back
2,538,445 A * 1/1951 Derbenwick et al.
2,617,343 A * 11/1952 Bowman
2,730,068 A * 1/1956 Reynolds et al.
3,082,777 A * 3/1963 Atkins et al.
3,563,416 A * 2/1971 Dobrink
3,861,409 A * 1/1975 Taniguchi
4,009,050 A * 2/1977 Beyer et al.
4,017,330 A 4/1977 Aidlin et al.
4,074,654 A * 2/1978 Noguchi et al.
4,319,930 A * 3/1982 Yano et al.
4,346,722 A * 8/1982 Schregenbeger
4,472,272 A * 9/1984 Capannoli
4,667,690 A * 5/1987 Hartnig
4,683,009 A * 7/1987 Shriver
4,834,123 A * 5/1989 McBrady
5,409,545 A 4/1995 Levey et al.
5,598,859 A * 2/1997 Kronseder
5,865,903 A * 2/1999 Duncan

FOREIGN PATENT DOCUMENTS

DE 31 17 294 A1 5/1980
EP 0 244 865 A1 5/1987
JP 03324975 10/1991

* cited by examiner

*Primary Examiner*—Frankie L. Stinson
(74) *Attorney, Agent, or Firm*—Diller, Ramik & Wight

(57) ABSTRACT

A rinsing device having a plurality of rinse modules, each of which has at least one circular turret adapted to transport containers through the rinsing device. The turrets are arranged to rotate about a substantially horizontal axis, the axis being offset from the horizontal by an angle sufficient to ensure drainage of cleaning fluid from the containers under the influence of gravity. The containers are preferably supported around the periphery of the turret with their longitudinal axes parallel to the axis of rotation of the turret.

9 Claims, 3 Drawing Sheets

RINSING DEVICE

BACKGROUND OF THE INVENTION

The present invention relates to rinsing devices for multi-stage cleaning of containers. In particular, the invention provides a modular rinsing device suitable for removing forming lubrication and gear oil from cans after their manufacture.

The can forming process is a "wet" process. The cans are lubricated during the various forming operations and therefore have to be cleaned before they can be coated or filled. Cleaning of the newly manufactured cans is carried out in a number of stages, usually commencing with rinsing the cans in water and/or detergents and finishing with rinsing in de-ionised water. The number of cleaning stages varies, depending upon the material from which the can is made and the finishing processes to be applied to the cans, such as etching, coating etc.

Conventional rinsing devices comprise a plurality of washing and associated drying stages through which the cans are transported on a conveyor belt. The cans are inverted, with their open ends in contact with the belt. The belt is provided by an open-work mat which allows the cleaning solution to be sprayed into and drain from the cans. As the cans pass through the washing stages of the device, high pressure nozzles spray cleaning solution (for example, water) onto the insides and outsides of the cans. After each washing stage, the cans pass into the associated drying stage of the rinsing device where they are dried using air nozzles or air knives directed onto the passing cans. The cleaning fluid drains from the cans through the holes in the conveyor belt.

There are a number of disadvantages with such conventional rinser designs. As the washing and drying stages are generally arranged linearly, along a conveyor belt, and there are usually a number of such washing and drying stages, the rinsing apparatus tends to occupy a large amount of space. Furthermore, as the conveyor belt passes through the washing and drying stages with the cans, the belt has to be washed and dried during each stage of the process, in addition to the cans, to prevent cross contamination in adjacent stages of the rinser. Finally, the spray nozzles and air nozzles are impeded from reaching the insides of the cans by the mat on which the cans are carried. The mat also restricts drainage of the cleaning fluid from the cans.

GB 2041338A describes an apparatus for treating cans, which comprises a number of modules. Each module comprises a pair of drums, which rotate about vertical axes and are used to carry the cans through the various treatment stages. As the cans progress through the device, they are transferred from one drum to the next, thereby minimising cross contamination between stages. Whilst this device is more compact than the conventional rinsing devices described above, it still takes up a significant amount of floor space.

CH 459787 describes a bottle washing device, again comprising a plurality of rotating drums, which transport the bottles through the device. The drums are arranged to rotate about horizontal axes, which lie parallel to one another in the same horizontal plane. By mounting the drums vertically, the floor space occupied by this device is much smaller than that occupied by the horizontally arranged drums described in GB 2041338A. However, a disadvantage of this arrangement is that the liquid used to wash and rinse the bottles remains inside the bottles until they pass through the part of the rotation cycle in which they are in an inverted position.

SUMMARY OF THE INVENTION

The aim of the present invention is to provide a modular rinsing device, having a smaller footprint (i.e. area of floor space occupied by the device) than the devices described in the prior art, whilst maintaining adequate drainage of the washing and rinsing fluids from the device. It will be appreciated that to obtain the most compact unit, the transport drums should be mounted vertically (rotating about horizontal axes), but this arrangement does not provide sufficient drainage of cleaning fluid from the containers. For maximum drainage of cleaning fluid, the drums should be mounted horizontally (rotating about vertical axes) with the open end of the containers pointing towards the floor and generally unobstructed. However, this arrangement takes up more floor space.

Accordingly, the present invention provides a rinse module for a rinsing device, comprising at least one circular turret rotatable about a substantially horizontal axis and adapted to transport containers through the rinse module, where they are rinsed with cleaning fluid, characterised in that the or each turret is adapted to support the containers around its periphery with their open ends pointing downwards at all times during the rotation cycle, and the axis of rotation of the or each turret is arranged at an angle to the horizontal sufficient to ensure drainage of the cleaning fluid from the containers by gravity.

The turrets are arranged at a slight angle to the vertical (i.e. with their axis of rotation at an angle to the horizontal). This allows considerable space saving to be achieved, whilst the slight angle ensures adequate drainage of cleaning fluid from the container under the influence of gravity. The containers are mounted around the periphery of the circular turrets, preferably with their longitudinal axes parallel to the axis of rotation of the turret. The containers are supported on the turrets, with as little obstruction of the open end of the container as possible. Mounting the containers in this way, improves access for spray nozzles and air knives, used to wash and dry the containers respectively. The containers are orientated with their open ends pointing downwards to facilitate drainage of the cleaning fluid.

For a straight sided container such as a can, the inventors have determined that mounting the turrets at an angle of 15° to the vertical (with their axis of rotation at 15° to the horizontal), is sufficient to achieve adequate drainage of the cleaning fluid from the container. Obviously containers having shaped sides or significantly reduced neck diameters may require the turrets to be mounted at a greater angle to the vertical, to ensure adequate drainage.

Preferably, each rinse module comprises a washing stage and a drying stage. The washing stage and drying stage have independent circular turrets to transport the containers through the stage and means to transfer the containers from one turret to the next at the end of each stage. The drying stage minimises the amount of moisture carried by the containers into the next rinse module and therefore reduces cross contamination as the containers pass from one rinse module to the next. Provision of separate circular turrets in the washing and drying stages has the advantage that the drying stage turret remains substantially dry, as only the wet containers are transferred from the washing stage to the drying stage of the rinse module. The drying stage turret is not subjected to the spray of cleaning fluid. Thus, the turret does not have to be dried by the air knives and the containers can be dried more quickly and effectively.

In a preferred embodiment of the invention, the turrets in the washing stage and drying stage are mounted about substantially horizontal axes which are arranged parallel to one another but offset vertically. Thus, the turrets are staggered with respect to one another, with the drying stage turret mounted above the washing stage turret. This arrangement again reduces the footprint of the device and means that the two turrets can drain into the same collection tank.

The containers may be supported around the periphery of each turret between freely rotatable mandrels and a stationary guide rail suitably spaced from, but following the contour of the circumference of turret. In this arrangement, the turret is provided with a number of pockets, defined by adjacent mandrels, with the containers supported in the pockets. The turret is rotated so that the containers are carried past suitably arranged spray nozzles and air knives in the washing and drying stages respectively. Preferably, the guide rails are arranged to apply a slight pressure between the containers and the inner mandrels, so that the containers rotate about their longitudinal axis as they move past the spray nozzles and air knives on the rotating turret. Alternatively, the rotation of the mandrels may be driven, thereby driving rotation of the containers about their longitudinal axis.

Alternatively, the turret may take the form of a "star wheel" with a plurality of pockets located around the periphery of the turret. A stationary guide rail is again used to support the containers, whilst the sides of the pockets drive the containers past the spray nozzles and air nozzles.

Preferably, the contact points on the mandrels, pockets and/or guide rails (where they touch the containers) are made from a low absorbency, non-marking material, such as polyethylene. Contact between the container and the mandrels is minimised by providing rings of material around the circumference of the mandrels, in the form of O rings, for example. Preferably, the material on the contact surface of the guide rails provides sufficient frictional contact with the containers that it "drives" rotation of containers about their longitudinal axis as they are carried along the guide rail by the rotating turrets.

At the transfer points from one turret to the next, the guide rails are arranged to ensure that the containers are transferred between turrets. As the risk of container jams is highest at these transfer points, the guide rails are preferably adapted to provide access to the turrets in this area, to allow removal of any jam. Access to the pockets at the transfer points may be provided, for example, by a spring loaded portion of the guide rail, which can be opened by an operator to reveal the pockets.

In the washing stages of the rinsing device, cleaning fluid (such as water, de-ionised water or detergents) is sprayed onto the passing containers by spray nozzles mounted along the path of the carrier. Preferably, de-ionised water is used as the cleaning fluid in the last rinse module to ensure that the containers are not smeared or streaky as they leave the rinser. In the preceding rinse modules, water may be used as the cleaning fluid. Preferably, the waste cleaning fluid from each rinse module is collected in an associated reservoir and is used to supply spray nozzles in the preceding rinse module. Thus, the containers are washed using progressively cleaner cleaning fluid as they move through the rinser. This arrangement reduces the water and or detergent consumption of the rinsing device.

The inventors have determined that the volume of cleaning fluid sprayed on to the cans is more important than the pressure at which the sprays operate. Therefore, the nozzles or spray bars in the washing stage of the rinse module are arranged to maximise the flow rate of cleaning fluid passing over the containers. This may be achieved by providing more nozzles or by adapting the design of the nozzles so that they can supply a higher flow rate of cleaning fluid. This allows an effective rinsing device to be provided without using the high pressure pumps, normally associated with conventional rinsing devices.

In a can making line, most of the contaminants on the cans are oil and grease. Where water is used as a cleaning fluid, these contaminants will tend to collect on the surface of the waste water reservoirs and needs to be removed before the water is used in the spray bars of the preceding rinse modules. Floating contaminants may be removed, for example, using a simple weir arrangement. Preferably, the reservoir tanks are of a suitable size to ensure that the water in the reservoirs is held for a sufficient period of time to allow solids to settle onto the base of the tank, before the water is recycled. Larger reservoir tanks also dilute any contaminants draining into the tanks from the rinse modules.

In the drying stages of the rinsing device, air nozzles or air knives are directed onto the passing containers to remove as much moisture as possible before they are transferred into the next rinse module. Preferably, a negative pressure is created inside one or more of the rinse modules, to remove vapour from the containers and keep them as clean as possible. For example, fans may be provided in ducting from the rinse module to extract vapour from that module.

The rinse modules may be provided with the washing stage and drying stage pre-arranged within the module. For example, where the washing and drying stage have separate circular turrets arranged in a staggered formation, the turrets and guide rails may be aligned within the rinse module and fixed in this orientation to ensure smooth transfer of the containers between the turrets. This allows the rinsing device to be set up with any number of rinse modules connected together, using one module as a datum against which the other modules can be aligned. This arrangement also allows simple replacement of a rinse module where necessary.

Preferred embodiments of the invention will now be described, by way of example only, with reference to the drawings in which:

DESCRIPTION OF THE PREFERRED EMBODIMENTS

Figure 1:
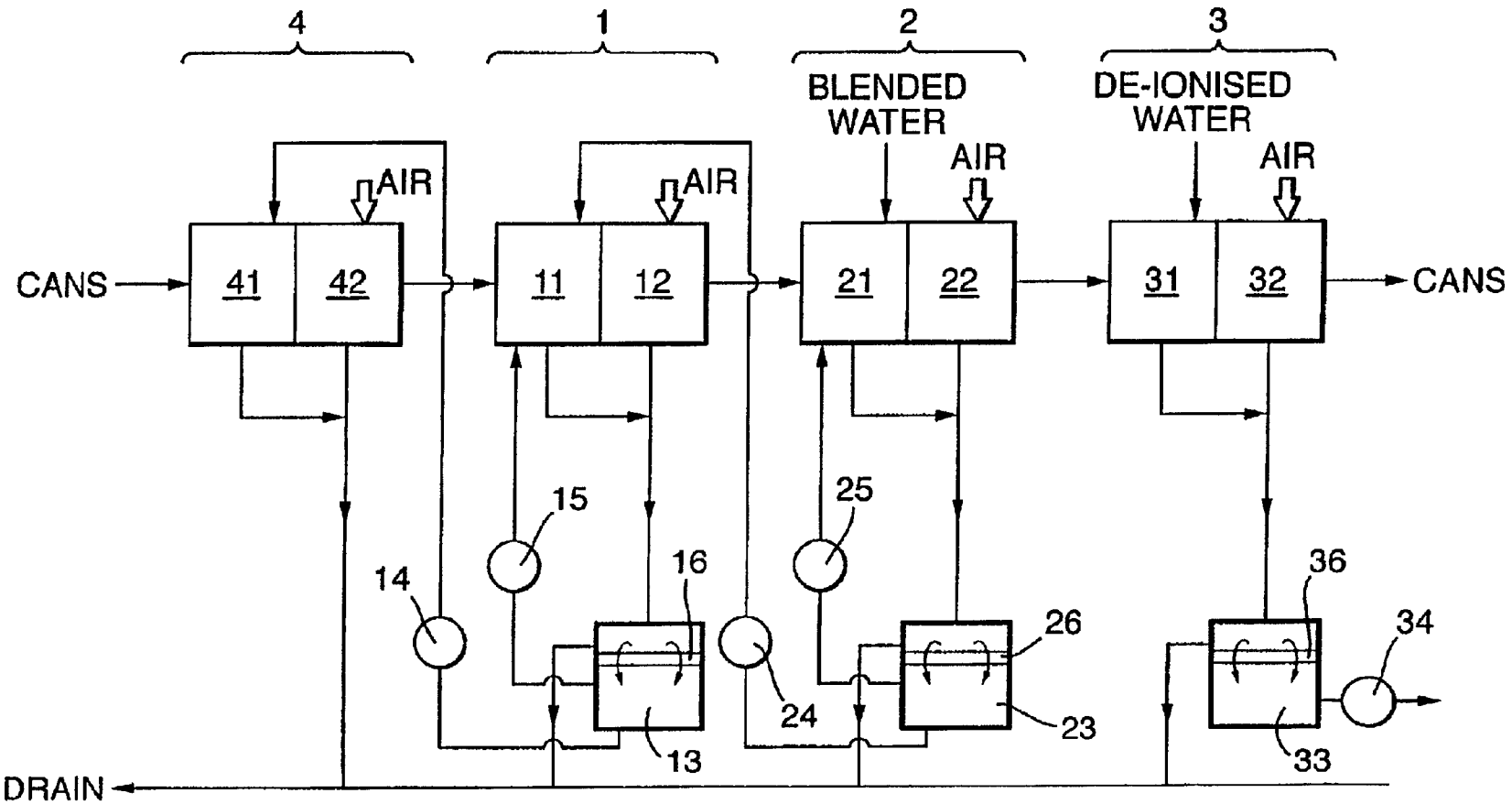
FIG. 1 shows a block diagram of one embodiment of the rinsing device according to the invention, showing the flow path of the water, air and cans through the rinser.

Referring to FIG. 1, the rinsing device comprises three rinse modules 1, 2, and 3 and a pre-rinse module 4. Each of these modules comprises a washing stage 11, 21, 31, 41 and a drying stage 12, 22, 32, 42.

Each rinse module 1, 2, 3 is provided with an associated reservoir tank 13, 23, 33. Preferably the reservoir tanks 13, 23, 33 have a large volume (about 2000 liters for example) to allow good flow balancing and to dilute contaminants and allow solid particles to settle onto the base of the tanks. The main contaminants from the washing of cans are oils and grease, which tend to float on the surface of tanks. Therefore, each tank 13, 23, 33 is provided with a weir 16, 26, 36 providing an overflow from the surface of the tank at a flow rate of about 1 liter per minute. The flow rate of the overflow may be controlled by manual inspection and a simple ball valve arrangement. Alternatively, the overflow flow rate may be controlled automatically via a penstock and flow measurement device. The overflow from tanks 13, 23, 33 drains into the common effluent drain within the factory.

Cans are delivered to the rinser at variable speeds between 220 and 405 cans per minute. The rinser speed is matched to the can bodymaker speed +/– modulation speed using sensor control on the infeed to the rinser.

The cans enter the pre-rinse module 41 and are transported through this module by a rotating circular turret. As the cans pass through the washing stage 41, wash medium (normally water) at low pressure (about 2–3 barG), is sprayed onto the surfaces of the cans at a flow rate of about 10–30 liters per minute, preferably about 25 liters per minute. The spray nozzles in washing stage 41 are supplied from the reservoir tank 13, via the low pressure pump 14.

The cans then pass into the drying stage 42 where air blowers are directed onto the cans to remove as much moisture from them as possible. The waste wash medium is allowed to drain, by gravity, from the pre-rinse module 4 into a common effluent drain within the factory.

Next, the cans are transferred to another circular turret and are transported through rinse module 1. As the cans pass through the washing stage 11, wash medium at a higher pressure (about 14 barG) is sprayed on to the surfaces of the cans at a flow rate of about 100–130 liters per minute. The high pressure rinse spray nozzles in washing stage 11 are supplied from the reservoir tank 13, via the high pressure pump 15. The high pressure pump 15 has a constant output but the spray nozzles may be adjusted using a regulator, which allows some water to bypass back to the reservoir tank 13. Reducing the amount of water bypassed to the tank 13, increases the pressure of the spray nozzle pressure.

At the end of washing stage 11, the cans enter a low pressure part of the wash cycle, where they are sprayed with wash medium at low pressure (about 2–3 barG) and a flow rate of about 10–30 liters per minute, preferably about 25 liters per minute. The low pressure spray nozzles are supplied from reservoir tank 23, via the low pressure pump 24. This final, low pressure part of the washing cycle, is supplied with wash medium from reservoir tank 23, associated with rinse module 2, to ensure that any moisture remaining on the cans when they enter rinse module 2 is as clean as the wash medium used in that rinse module.

The cans then pass into the drying stage 12 where air blowers are directed onto the cans to dry as much moisture from them as possible. The waste wash medium from rinse module 1 is allowed to drain, by gravity, into reservoir tank 13.

Next, the cans are transferred to another circular turret and are transported through rinse module 2. As the cans pass through the washing stage 21, wash medium at higher pressure (about 14 barG) is sprayed on to the surfaces of the cans at a flow rate of about 100–130 liters per minute. The high pressure rinse spray nozzles in washing stage 21 are supplied from the reservoir tank 23, via the high pressure pump 25.

At the end of the washing stage 21, the cans enter a low pressure part of the wash cycle, where they are sprayed with wash medium at low pressure and a flow rate of about 10–30 liters per minute, preferably about 25 liters per minute. The low pressure spray nozzles are supplied directly from the factory supply. This low pressure part of the washing cycle uses water from the factory supply to minimise the contaminants in the moisture remaining on the cans when they enter rinse module 3. The factory supply is also used for fluid make up within the reservoir tanks 13, 23.

The cans then pass into the drying stage 22 where air blowers are directed onto the cans to remove as much moisture from them as possible. The waste wash medium from rinse module 2 is allowed to drain, by gravity, into reservoir tank 23.

Finally, the cans are transferred to another circular turret and are transported through rinse module 3. As the cans pass through the washing stage 31, de-ionised water at low pressure (about 4 barG) is sprayed on to the surf aces of the cans at a maximum flow rate of about 65 liters per minute.

The cans then pass into the drying stage 32 where air blowers are directed onto the cans to remove as much moisture from them as possible. The waste water from rinse module 3 is allowed to drain, by gravity, into reservoir tank 33. The water from reservoir tank 33 is recycled to the factory supply via pump 34, at a flow rate below that of the de-ionised water supplied to the spray nozzles in washing stage 31 (at about 60 liters per minute, for example).

Rinse modules 1, 2 and 3 are preferably identical and adaptable, to allow interchangeability with other modules The modules are arranged to allow a fluid sealed connection of additional rinse modules at the infeed or discharge end of the modules. This arrangement provides a flexible system which can easily be expanded to provide additional washing stages where required. Furthermore, rinse modules can easily be removed and replaced where necessary, for example for repairs or maintenance.

Figure 2:
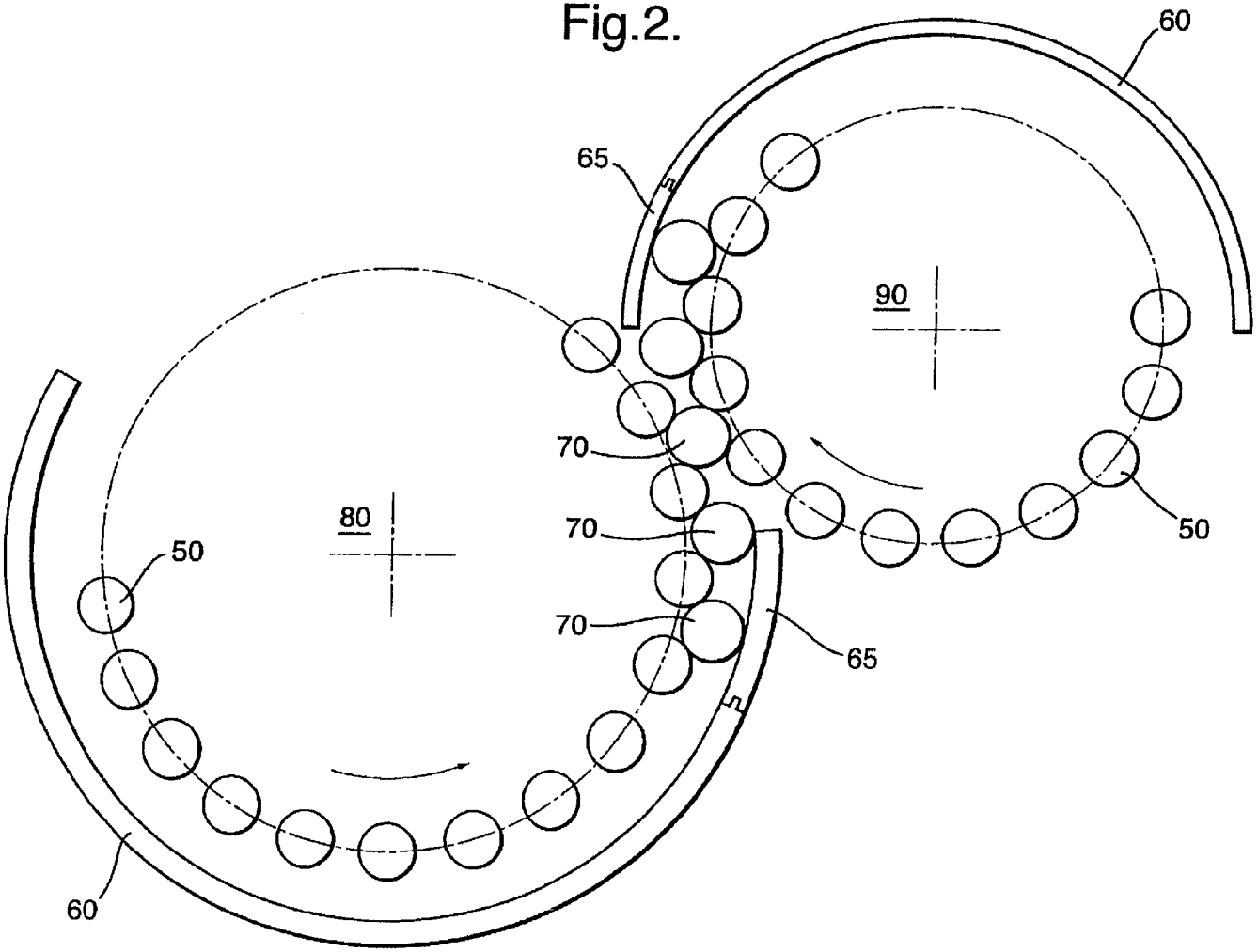
FIG. 2 shows a plan view of the circular turrets in a rinse module according to one embodiment of the invention.
Figure 3:
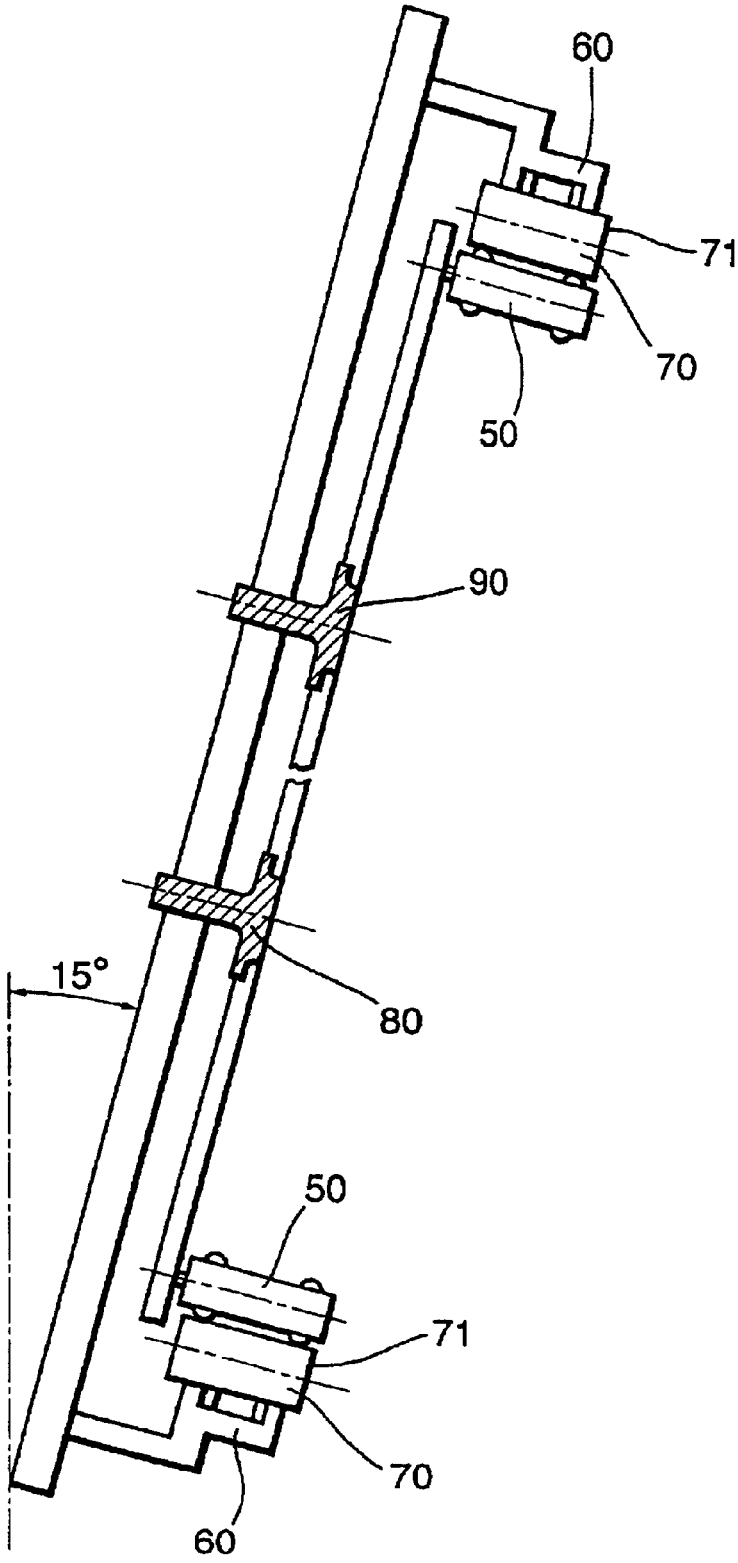
FIG. 3 shows a side view of the turrets shown in FIG. 2, mounted in a substantially vertical configuration within a rinse module.

Referring to FIGS. 2 and 3, a rinse module according to a preferred embodiment of the invention comprises two circular turrets 80, 90, which transport the cans through the washing stage and drying stage respectively. Cans are directed onto the infeed of the washing turret 80 by means of guide rails 60 on the infeed of turret 80. A plurality of freely rotatable mandrels 50 are arranged around the perimeter of turrets 80 and 90 and the cans 70 are held in pockets defined between adjacent mandrels 50. As shown in FIG. 3, the cans 70 are supported in the pockets with their longitudinal axes parallel to the axis of rotation of the turret 80, 90. A stationary guide rail 60 is arranged spaced from, but following the contour of the circumference of each turret 80, 90. The spacing between the guide rail 60 and the turret 80, 90 is sufficient to support the can 70 within the pockets defined by adjacent mandrels 50 whilst providing sufficient frictional contact that the cans 70 are rotated about their longitudinal axis as they move past the stationary guide rail 60. The rotation of the cans 70 is accommodated by rotation of the mandrels 50 about their longitudinal axis.

As the cans 70 move around the periphery of the turret 80, they are sprayed by a series of spray nozzles (not shown) which are arranged to spray wash medium over the internal and external surfaces of the cans 70. The cans 70 are then transferred onto the drying turret 90 by means of the guide rails 60. As the transfer point is the area where most can jams are likely to occur, the guide rails 60 at this point are provided with a spring loaded, hinged portion 65 which may be opened by an operator to provide access to the turrets 80, 90 at the transfer point.

Once transferred to the drying turret 90, the cans are again supported within pockets defined between adjacent mandrels 50 and an outer guide rail 60 which follows the contour of the circumference of the turret 90. As the cans move around the periphery of the drying turret 90, they are acted upon by a series of air blowers or air knives (not shown) which are arranged to remove as much moisture as possible from the cans 70.

As shown in FIG. 3, the circular turrets 80, 90 are preferably arranged at an angle of 15° to the vertical, with the open ends 71 of the cans 70 pointing towards the floor. This arrangement reduces the amount of floor space occupied by each rinse module whilst ensuring adequate drainage of cleaning fluid from the cans, under the effect of gravity. The cans 70 are supported by the mandrels 50 and the guide rails 60 with as small contact surfaces as possible. In this arrangement, the open end 71 of the can is not restricted by the support structure of the turrets and guide rails.

As shown in FIGS. 2 and 3, the washing turret 80 and drying turret 90 are arranged with their axes of rotation parallel but offset vertically, so that the drying turret 90 is mounted above the washing turret 80. This arrangement reduces the floor space occupied by the rinse module and also allows both turrets 80, 90 to drain into the same reservoir tank.

The guides, spray bars and mandrels are preferably mounted using quick release mechanisms to ensure ease of maintenance. The drive system for the turrets may be provided by a belt pulley system, servo's, chains, gears or other suitable alternative. Finally, to provide a compact unit, the rinse modules may be mounted on top of their respective reservoir tanks.

The control system used to detect the movement of cans through the rinsing device is the same in each rinse module. The control systems in all rinse modules are integrated to allow the movement of cans to be tracked as they pass through the various modules of the rinsing device.

Although a preferred embodiment of the invention has been specifically illustrated and described herein, it is to be understood that minor variations may be made in the apparatus without departing from the spirit and scope of the invention, as defined the appended claims.

What is claimed is:

1. A rinse system comprising first and second rinse modules, at least a washing stage in said first rinse module and a washing stage and a drying stage in said second rinse module, said first rinse module washing stage including a first rinse module washing stage turret rotatable about an axis of rotation disposed at an angle to the horizontal sufficient to ensure drainage of washing medium from containers during transport thereof by said first rinse module washing stage turret, means for defining pockets of said first rinse module washing stage turret each adapted to receive a container therein with an open container end pointing downwardly at all times during first rinse module washing stage turret rotation, means for guidingly supporting containers during circumferential transport along a first container path of travel between container in-feed into a pocket of said first rinse module washing stage turret and discharge from a pocket thereof, means for washing containers with a washing medium during transport thereof by said first rinse module washing stage turret, said second rinse module washing stage and said second rinse module drying stage including a respective second rinse module washing stage turret and a second rinse module drying stage turret each rotatable about a respective axis of rotation, said last-mentioned two axes of rotation being disposed in substantially parallel relationship to each other and at an angle to the horizontal sufficient to ensure drainage of washing medium from containers during transport thereof by said second rinse module washing stage turret and said second rinse module drying stage turret, means for defining pockets of said second rinse module washing stage turret and said second rinse module drying stage turret each adapted to receive a container with an open container end thereof pointing downwardly at all times during second rinse module washing stage turret rotation and second rinse module drying stage turret rotation, said second rinse module washing stage turret and said second rinse module drying stage turret each being associated with means for guidingly supporting the containers during circumferential transport along a container path of travel between container in-feed from said first rinse module into a pocket of said second rinse module washing stage turret and container discharge from a pocket of said second rinse module drying stage turret, means for washing containers with a washing medium during transport thereof by said second rinse module washing stage turret, means for directing air onto the containers during transport thereof by said second rinse module drying stage turret to remove washing medium therefrom thereby expediting container drying, said second rinse module drying stage turret axis being located vertically above said second rinse module washing stage turret axis, and said second rinse module drying stage turret being located at least in part above said second rinse module washing stage turret thereby reducing the floor space occupied by the second rinse module.

2. The rinse system as defined in claim 1 wherein said first rinse module includes a drying stage through which containers are transported between container discharge from said first rinse module washing stage turret and container in-feed to said second rinse module washing stage turret.

3. The rinse system as defined in claim 2 including a third rinse module, said third rinse module including a washing stage and a drying stage, said first, second and third rinse modules defining successive paths of travel for containers from in-feed to discharge.

4. The rinse system as defined in claim 1 wherein said first rinse module includes a drying stage through which containers are transported between container discharge from said first rinse module washing stage turret and container in-feed to said second rinse module washing stage turret, said first rinse module drying stage includes a first rinse module drying stage turret rotatable about an axis of rotation, said last-mentioned axis of rotation being disposed in substantially parallel relationship to said first rinse module washing stage turret axis of rotation and at an angle to the horizontal sufficient to ensure drainage of washing medium from containers during transport thereof by said first rinse module drying stage turret, means for directing air onto the containers during transport thereof by said first rinse module drying stage turret to remove washing medium therefrom thereby expediting container drying, said first rinse module drying stage turret axis being located vertically above said first rinse module washing stage turret axis, and said first rinse module drying stage turret being located at least in part above said first rinse modular washing stage turret thereby reducing the floor space occupied by the first rinse module.

5. The rinse system as defined in claim 1 including means for delivering washing medium to the washing means of the first rinse module at a first pressure, means for delivering washing medium to the container washing means of the second rinse module washing stage, and means for regulating the delivery of the washing medium such that the pressure of the washing medium delivered to the second rinse module washing stage is greater than the pressure of the washing medium delivered to the first rinse module washing stage.

6. The rinse system as defined in claim 1 including first and second means for delivering washing medium at respective relatively higher and lower pressures to respective upstream and downstream paths of travel of at least one of said first and second rinse module washing stages whereby containers transported therethrough are subject to higher pressure washing medium at in-feed and lower pressure washer medium toward discharge.

7. The rinse system as defined in claim 1 including first and second means for delivering washing medium at respective relatively higher and lower pressures to respective upstream and downstream paths of travel of at least one of said first and second rinse module washing stages whereby containers transported therethrough are subject to higher pressure washing medium at in-feed and lower pressure washer medium toward discharge, and said low pressure washing medium is supplied to said second rinse module washing stage from a previous rinse module.

8. The rinse system as defined in claim 1 including means for supplying de-ionized water as the washing medium to at least one of said container washing means.

9. The rinse system as defined in claim 1 including means for supplying blended water as the washing medium to at least one of said container washing means.

* * * * *